United States Patent [19]

Graham

[11] 4,085,550

[45] Apr. 25, 1978

[54] APPARATUS FOR ABRASIVELY TREATING INSULATION PRODUCTS

[75] Inventor: Robert Graham, Chester-le-Street, England

[73] Assignee: Newalls Insulation Company Limited, Manchester, England

[21] Appl. No.: 768,789

[22] Filed: Feb. 15, 1977

[30] Foreign Application Priority Data

Feb. 21, 1976 United Kingdom ..... 06898/76

[51] Int. Cl.[2] ..... B24B 21/02

[52] U.S. Cl. ..... 51/145 T

[58] Field of Search ..... 51/145 R, 145 T, 105 R, 51/108 R, 237 T; 269/48.1

[56] References Cited

U.S. PATENT DOCUMENTS

| | | | |
|---|---|---|---|
| 2,526,900 | 10/1950 | Remigton | 51/215 UE |
| 2,667,139 | 1/1954 | Campbell | 269/48.1 |
| 2,855,730 | 10/1958 | Ferguson | 51/145 R |
| 3,071,903 | 1/1963 | Wing | 51/145 R X |
| 3,405,505 | 10/1968 | Mistarz | 51/215 UE X |
| 3,479,772 | 11/1969 | Yoder | 51/145 R |
| 3,745,728 | 7/1973 | Boehm | 51/145 T |
| 3,950,895 | 4/1976 | Dakin | 51/108 R X |

*Primary Examiner*—Harold D. Whitehead
*Assistant Examiner*—Nicholas P. Godici
*Attorney, Agent, or Firm*—Oblon, Fisher, Spivak, McClelland & Maier

[57] ABSTRACT

Apparatus for applying an abrasive treatment to the outer surface of a length of tubular fibrous pipe insulation comprising a support, a mandrel rotatably mounted thereon for receiving a section to be treated, an abrading member at an abrasive treatment station, a mechanism for effecting relative displacement between the mandrel and the abrasive treatment station so as to present the outer surface of a section on said mandrel to the abrasive treatment station for abrasive treatment by the abrading member thereat, together with a member for rotating the section while so presented.

14 Claims, 4 Drawing Figures

FIG. 3
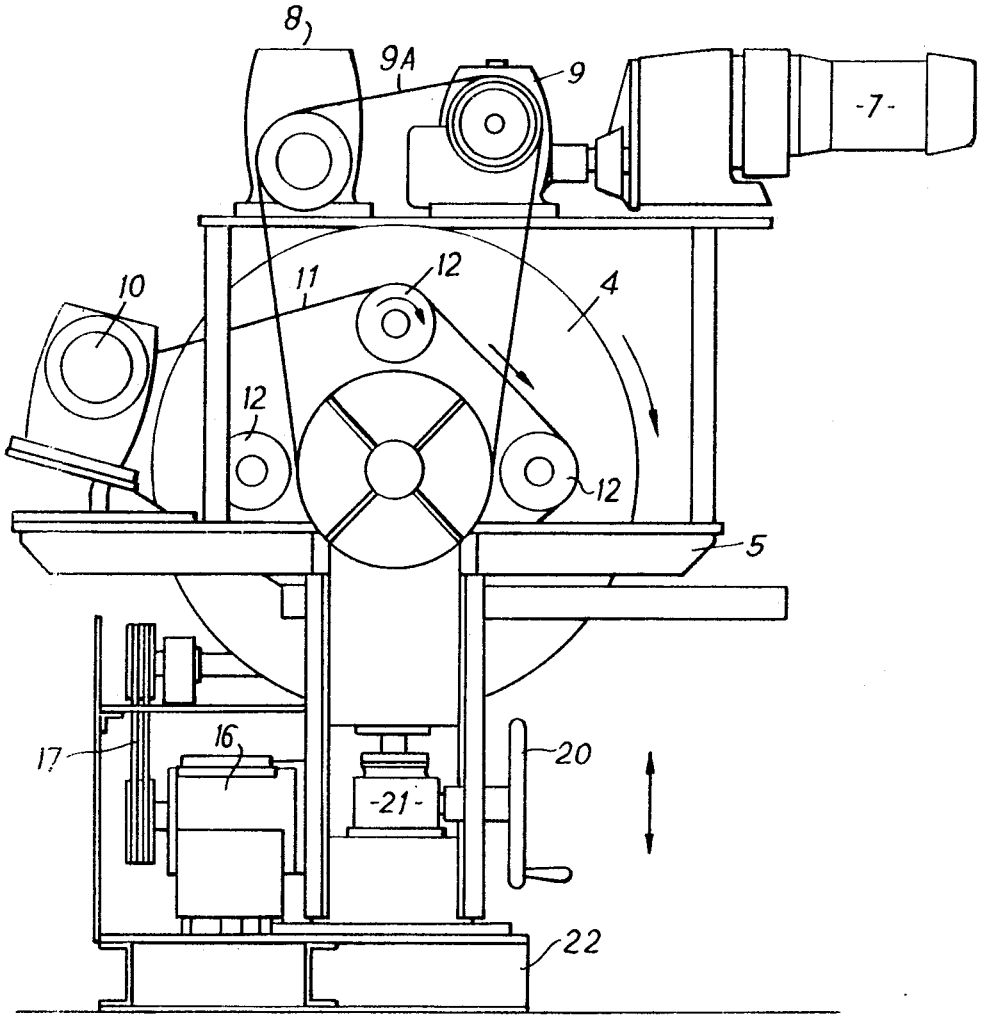
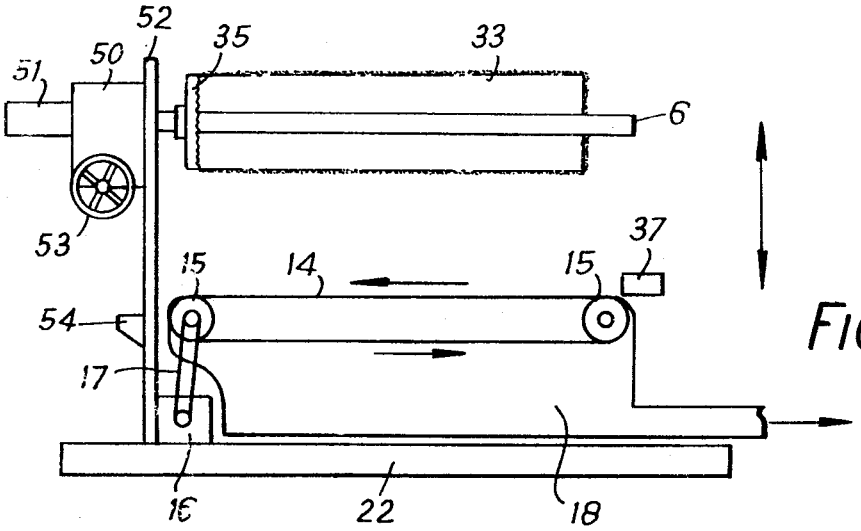
FIG. 4

APPARATUS FOR ABRASIVELY TREATING INSULATION PRODUCTS

This invention relates to the manufacture of lengths of tubular fibrous pipe insulation from bound mats of fibres such as glass or mineral wool. Such tubular pipe insulation is usually made by wrapping a length of a fibrous mat around a mandrel whose external diameter corresponds to that of the pipe to be insulated. The length of the mandrel corresponds to the length of tubular insulation to be made. The mat maybe either pretreated with a binding agent, which is caused to set in situ after wrapping on the mandrel, or the material may be treated with a binder after wrapping, which is then caused to set. For many applications, a thermosetting resin binder is commonly used. Such lengths of tubular fibrous pipe insulation are usually known as "sections" and will be so described throughout this specification. For convenience, one wall of the finished section is slit through axially to enable it to be fitted over an existing pipe without breaking the latter at any point. For ease of handling a partial slit may also be made in the opposite wall, from the inside. Alternatively, the section may be split longitudinally along a diameter into two halves which can be attached to a pipe with clamping straps.

Whilst the mandrel itself accurately defines the bore of the section, the external diameter and indeed the external surface appearance of the section may be difficult to control because of the somewhat ragged, fibrous nature of the starting material. The external surface of a section can be shaped by using an external sleeve, preferably foraminous to facilitate setting of the binder by circulating a hot air stream both around and through the section, but this approach demands not only a large stock of mandrels, but also an even larger stock of external sleeves, since the section wall thickness may have to be changed to meet different insulation requirements or specifications. Furthermore, the mandrel and sleeve must be kept sensibly concentric, which may present considerable handling problems in a production line process. It is also possible to smooth the outer surface of a section whilst setting the binder. For example, the section can be rotated on its mandrel whilst presenting its outer surface to a heated, concave curved stationary surface which smoothes and compresses the surface of the fibrous mat. Unfortunately, fibrous mats or fleeces can be of variable density and this smoothing technique may give a section of non-uniform wall thickness.

According to the present invention, an apparatus for applying an abrasive treatment to the outer surface of a section (as hereinbefore defined) comprises a support, a mandrel rotatably mounted thereon, for receiving a section to be treated, abrading means at an abrasive treatment station, means for effecting relative displacement between the mandrel and the abrasive treatment station so as to present the outer surface of a section on said mandrel to the abrasive treatment station for abrasive treatment by the abrading means thereat, together with means for rotating the section whilst so presented.

The abrasive treatment station can be mounted for movement towards and away from the mandrel, but it may be more convenient to mount the support for movement towards and away from the abrasive treatment station, the latter being then stationary.

More than one rotatably mounted mandrel may be employed, although it is not necessary to provide an abrasive treatment station for each mandrel because the arrangement may be such that the individual mandrels are each presented in turn to a single abrasive treatment station. For this latter case, it is preferred that the support is in the form of a turret, indexing means being provided to rotate the turret so as to achieve the desired presentation of the mandrels to the abrasive treatment station. The sections are preferably rotated by their mandrels whilst at the latter station and to this end the support is preferably provided with means for rotating the or each mandrel when so presented.

Preferably, the turret is provided with at least three mandrels so as to enable loading and/or unloading of two of the mandrels to take place whilst one mandrel is at the abrasive treatment station. More mandrels may be used and there may also be more than one abrasive treatment station, for example, coarse and fine abrasive treatments may be applied in turn.

A particularly preferred abrasive treatment is finishing by means of an endless abrasive-coated belt, one run of which is sensibly flat and against which a section is presented whilst being rotated by its mandrel, means being provided for re-circulating the belt in such a direction as to urge the section onto the mandrel.

Preferably the apparatus includes a device capable of engaging the free end of a mandrel whilst at the abrasive treatment station, the device being arranged to minimize deflection of the free end during abrasive treatment of a section thereon so that a sensibly constant distance is maintained between the surface of the section and the abrading means.

Advantageously, the apparatus also includes means for drawing sections onto and/or off the mandrel whilst remote from the abrasive treatment station. For example, an endless belt disposed with one run thereof parallel to the mandrel and spaced therefrom by approximately the wall thickness of a section can be used, the direction of travel of said run being arranged to either push a section onto the mandrel or pull it off, as appropriate.

As the apparatus presents a section to the abrasive treatment station, it is desirable that the initial contact between the surface of the section and the abrasive medium should not be abrupt in order to minimize the risk of portions of the rough, untreated surface being torn away. Accordingly, it is preferred that the relative displacement be carried out with at least two speeds, a relatively fast speed towards and away from the treatment station and a relatively slow speed during at least the final stage of approach to the treatment station and in particular immediately prior to and during initial contact between a section and the abrading means applying the abrasive treatment.

It is important to ensure that relative rotation between a section and the mandrel supporting it is not the cause of uneven or asymmetrical abrasion. One way of minimizing the risk of such relative rotation occurring is to provide the mandrel with a collar faced with a friction material and against which one end of the section is urged by the movement of the abrasive-coated belt referred to earlier.

Advantageously, the minimum spacing between mandrel and abrasive treatment station can be varied so as to facilitate treating sections of different outside diameters, and/or wall thickness, as well as enabling the pressure applied during treatment to be adjusted. Where sections of a different bore are to be treated, the mandrels themselves may have to be changed and the apparatus preferably then includes means to facilitate this, for example, individual mandrels may be mounted is sockets and retained therein by screws.

Where the support is a turret, as mentioned earlier, the mandrel or mandrels may be rotated by an individual electric motor or motors mounted on the turret, but an endless belt drive operated by a motor located on a supporting structure for the turret is preferred in the interests of simplicity. Such an endless belt drive has the advantage that the belt can be diverted out of driving engagement with the mandrel at a desired position of the turret. This is useful, for example, when a mandrel is to have a treated section removed from it by a run of an endless belt moving axially of the mandrel and where continued rotation might damage the surface of the section.

Further aspects of the invention will be apparent from the following description of two preferred embodiments which will be described by way of example with reference to the accompanying drawing in which:

FIG. 3 is an end view of the apparatus taken in direction B of FIG. 1 and

FIG. 4 is a schematic side elevation of another apparatus according to the invention.

In the interests of clarity, like reference numerals are applied to like parts in all four figures.

Figure 1:
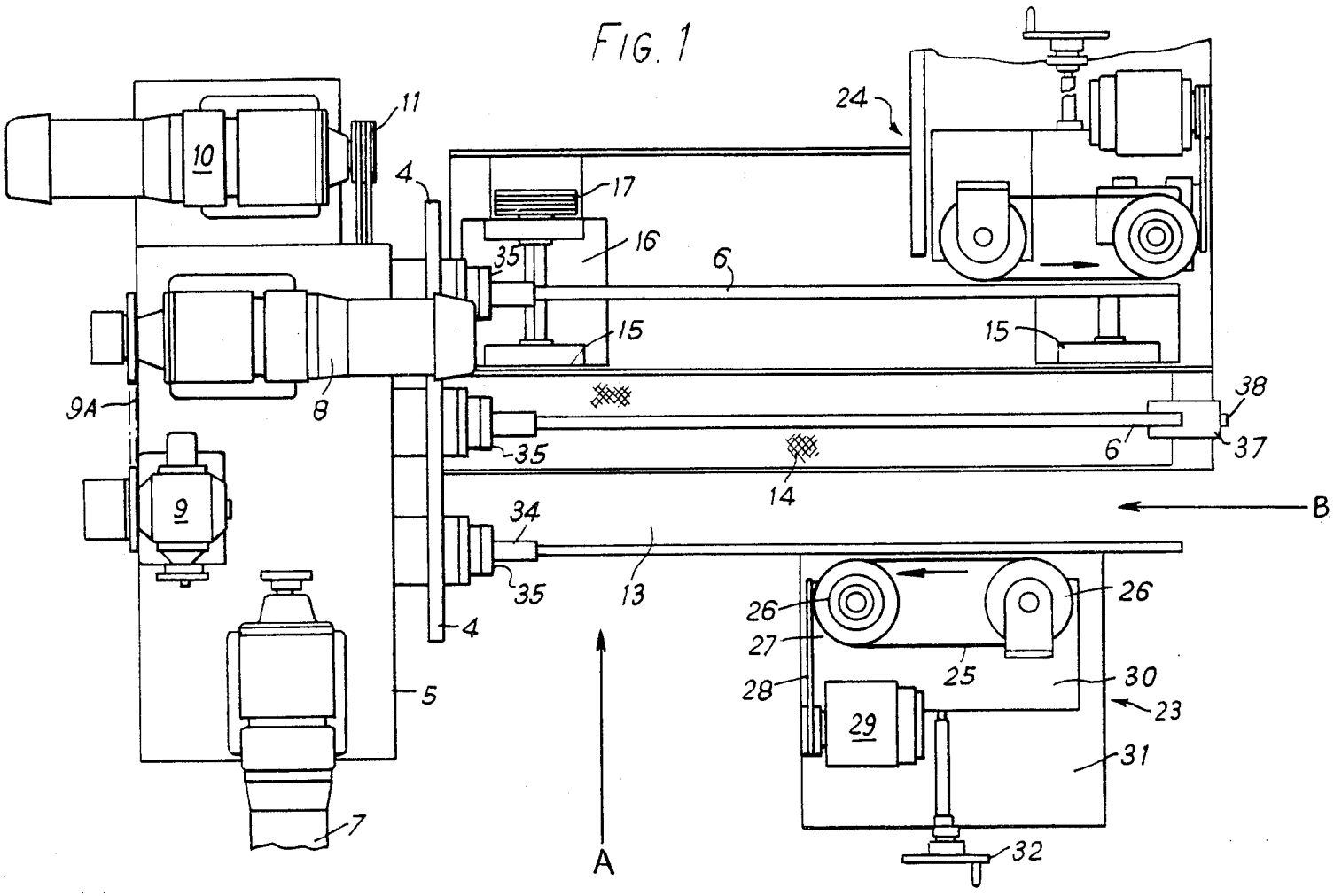
FIG. 1 is a plan view of an apparatus according to the invention for applying an off-line abrasive treatment to a section.
Figure 2:
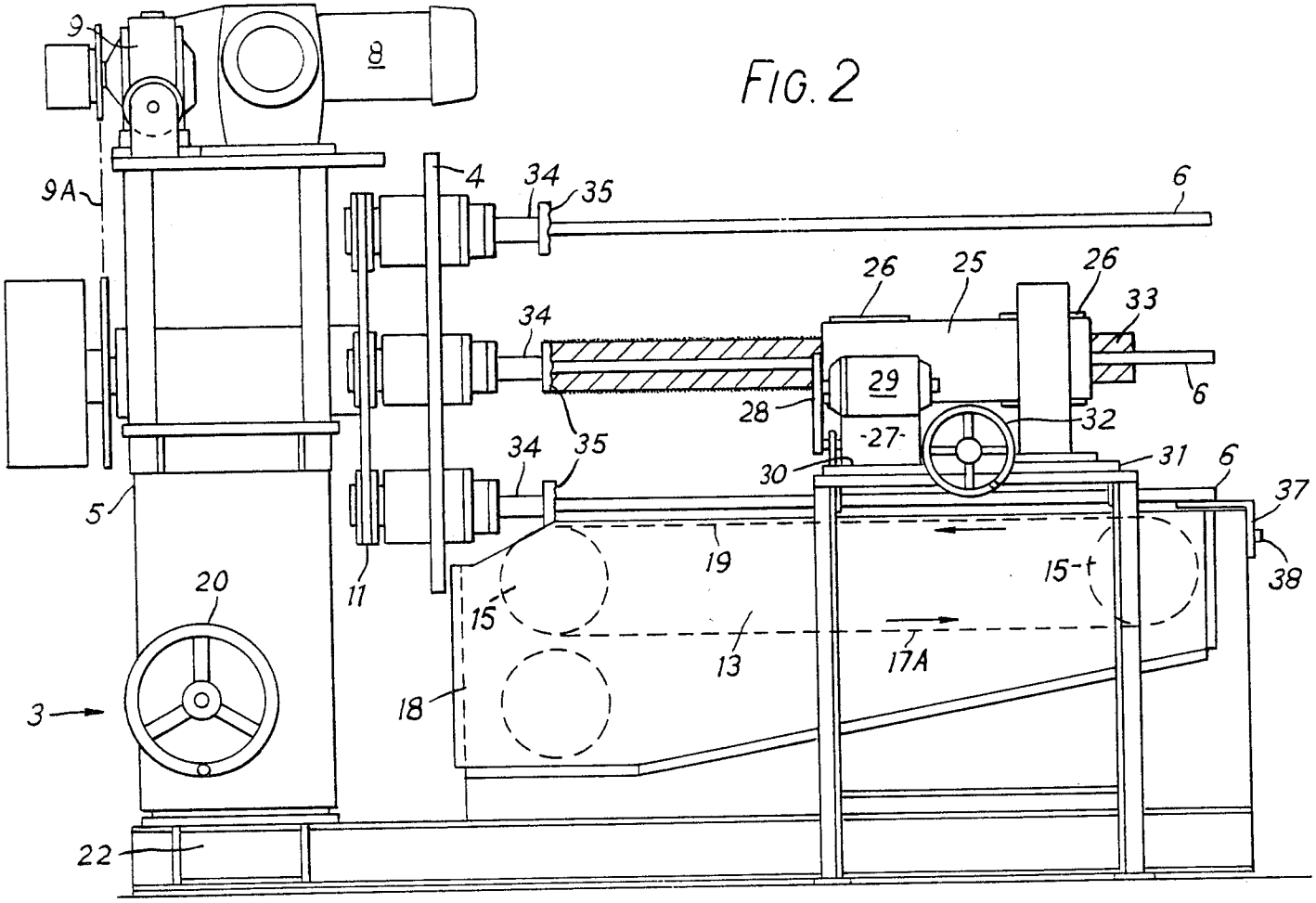
FIG. 2 is a side view of the apparatus taken in direction A of FIG. 1.

In FIGS. 1–3 inclusive, a turret 4, rotatably mounted to a supporting structure 5, carries four rotable mandrels 6, although only three are seen in any one figure. The turret is indexed through four positions mutually at right angles, by fast and slow-speed electric motors, 7 and 8 respectively through a gearbox 9 incorporating sprag clutches so that when any motor is not operating it is effectively disconnected from the turret, as will be further explained later. The turret and gearbox are driven by V-belts 9A.

A third electric motor 10 is connected to rotate the mandrels by means of a V-belt 11 which engages pulleys 12 located on the remote side of the turret from the mandrels. Because of the location of the motor 10 one of pulleys 12 is always disengaged from the belt, for reasons which will be discussed later.

An abrasive treatment station 13 is provided, as seen in plan in FIG. 1 and is partly-sectioned side elevation in FIG. 2. The station 13 comprises an endless, abrasive coated belt 14 mounted for re-circulation between drive rollers 15 and driven by an electric motor 16 through a belt 17A. The lower run 17 of the belt 14 is enclosed in a dust collection chamber, indicated at 18. The upper run 19 of the belt is supported (by means not shown) substantially parallel to the axes of the mandrels 6 and to the axis of rotation of the turret 4. The height of the turret relative to the station 13 is adjustable by a handwheel 20 and drive 21 mounted on a base 22 for the whole apparatus. At the station 13, a bracket 37 is provided, the upper face of which is arranged to lie under and engage the free end 38 of the mandrel. The mandrel-contacting surface of the bracket is spaced from the run 19 of the endless belt by a distance equal to the desired section wall thickness so that any eccentricity in the movement of the free end of the mandrel as it rotates cannot affect the section wall thickness. The position of the mandrel-coating surface relative to the run 19 can be adjusted by means of a nut and bolt 38.

Loading and unloading stations, 23 and 24 respectively are mounted at each side of the apparatus, as best seen in FIG. 1.

The loading station 23 comprises an endless belt 25 mounted for re-circulation between a pair of pulleys 26, one of which is connected through a gearbox 27 and a belt drive 28 to an electric motor 29. The apparatus is mounted on a base plate 30 so that one run of the belt is parallel to the axis of the mandrels 6. The base plate 30 is itself slidably mounted in a support bracket unit 31 which carries a hand wheel 32 whereby the spacing between the belt and mandrels can be adjusted.

Because the unloading station 24 is virtually identical to the loading station 23 like reference numerals have been applied to its components and it will not be described in further detail.

The respective directions of travel of all the endless belts, including the drive belts are, where appropriate, indicated by arrows.

In operation, starting with all the mandrels empty, an untreated section 33 is pushed onto the mandrel at the loading station. This mandrel is rotating, and the belt 25 engages the surface of the section and draws it fully onto the mandrel, pressing it firmly against a friction-faced collar 34 at the turret end of the latter. The friction face 35 grips the end of the section and ensures that it rotates with the mandrel. At this point, the indexing drive motors are energized, firstly the fast speed motor 7 which drives the turret rapidly through the major part of a 90° turn (clockwise in FIG. 3). The motor 7 is then turned off and the slow speed motor 8 turned on to complete the indexing. The actual control of the indexing motors is conventional, using microswitches operated by the section 33 and cams associated with the turret drive; it need not be described in detail here. As the slow speed motor takes control of the indexing, it slows down the rate of approach of the section to the run 19 of the abrasive-coated belt, so that the latter is contacted relatively gently. The section is of course still rotating with its mandrel and the indicated direction of travel of the run 19 ensures that the end of the section stays firmly in contact with the friction face 35 of the mandrel.

When the surface of the section has been abraded to give the desired section wall thickness the indexing process is repeated to carry the section away from the station 13 towards the unloading station 24 and as it approaches the latter, the drive belt 11 disengages from the pulley on the mandrel carrying the section, due to the geometry of the system. Shortly afterwards, the section is engaged by the belt 25 and pushed by the latter off the mandrel, for example into a collecting box or onto a conveyor (not shown).

It will be appreciated that the foregoing arrangement includes one indexing position which is not used. If desired, a preliminary abrasive treatment using a grinding roller or a linishing belt could be applied at this position.

The apparatus shown schematically in FIG. 4 is generally similar to, but somewhat simpler than that just described in relation to FIGS. 1–3. A single mandrel 6 is rotatably mounted in a support 50 and is rotated by a motor 51 mounted on the latter. The support is slidably mounted on a slideway 52 and its height relative to the base 22 can be varied using a handwheel 53. An adjustable limit stop 54 on the slideway 52 sets the minimum distance between the mandrel 6 and a finishing belt 14 at the desired section wall thickness, a bracket 37 being provided, as before, to prevent mandrel eccentricity from affecting the section wall thickness. Also, as before, a dust collection chamber 18 is provided to remove abraded material. Other parts identified be reference numerals correspond to those described earlier in relation to FIGS. 1-3 and need not be further discussed here.

In operation starting with the support in the position shown, the mandrel is manually loaded with a section (after switching-off the motor 51), the section being firmly pressed home against the friction-faced-collar 35. With the motor 51 energized and the section rotating on its mandrel, the handwheel 53 is used to rack the support down to the stop 54, thereby bringing the section surface against the finishing belt 14 which is travelling in the direction shown. The free end of the mandrel 6 then abuts against the upper face of the bracket 37, thereby ensuring that the treatment is evenly applied over the length of the section.

The rate of descent of the support is carefully controlled to make the engagement between the section and the belt not too abrupt; the direction of travel of the belt ensures that the section is pressed against the collar 35 and that there is a minimum of relative rotation between section and mandrel. When the treatment is complete, the support is racked back to its starting position, the motor 51 switched-off and the section removed from the mandrel. Obviously, this operation could be rendered semi or fully — automatic, as in the previously-described arrangement. Also a number of parallel mandrels could be mounted on the single support for simultaneous presentation to either a single finishing belt, or to a plurality of such belts, as desired.

I claim:

1. Apparatus for applying an abrasive treatment to the outer surface of a section comprising a length of bonded fibrous tubular pipe insulation, said apparatus comprising, a support, a mandrel rotatably mounted thereon for receiving a section to be treated, abrading means which comprises an endless, abrasive-coated belt and means for re-circulating said belt, in use, through a sensibly flat path parallel to the longitudinal axis of said mandrel with at least the length of a section presented to said flat path, the direction of travel of the belt in said flat path being selected whereby the section is urged onto the mandrel whilst presented to the abrading means at an abrasive treatment station, means for effecting relative displacement between the mandrel and the abrasive treatment station so as to present the outer surface of a section on said mandrel to the abrasive treatment station for abrasive treatment by the abrading means thereat, together with means for rotating the section whilst so presented.

2. Apparatus according to claim 1 wherein the support has a plurality of mandrels with parallel longitudinal axis which are rotatably mounted thereon together with means for rotating said mandrels.

3. Apparatus according to claim 1 wherein the support is constituted by a turret having a plurality of mandrels with parallel longitudinal axes thereon and which is itself rotatable whereby sections mounted on said mandrels are presented in turn to the abrasive treatment station.

4. Apparatus according to claim 1 further including means operable to maintain the mandrel during the abrasive treatment of a section thereon a prechosen distance from the abrading means, said distance corresponding to a desired section wall thickness.

5. Apparatus according to claim 1 further including means operable to draw sections onto the mandrel whilst the mandrel is remote from the abrasive treatment station.

6. Apparatus according to claim 1 further including means operable to draw sections off the mandrel whilst the mandrel is remote from the abrasive treatment station.

7. Apparatus according to claim 1 including means operable to draw a section onto the mandrel whilst remote from the abrasive treatment station, said means comprising an endless belt mounted for re-circulation with one run thereof substantially parallel to the mandrel and spaced therefrom by the wall thickness of a section, together with means for driving said one run in such a direction as to draw a section onto the mandrel.

8. Apparatus according to claim 1 including means operable to draw a section off the mandrel whilst remote from the abrasive treatment station, said means comprising an endless belt mounted for re-circulation with one run thereof substantially parallel to the mandrel and spaced therefrom by the wall thickness of a section, together with means from driving said one run in such a direction as to draw a section off the mandrel.

9. Apparatus according to claim 1 including first means operable to draw a section onto said mandrel whilst at a first location remote from the abrasive treatment station and further including second means operable to draw a section off said mandrel whilst at a second location remote from the abrasive treatment station.

10. Apparatus according to claim 1 wherein the means for effecting relative displacement between the mandrel and the abrasive treatment station is arranged to operate at a relatively slow speed immediately prior to and during initial contact between a section and the abrading means.

11. Apparatus according to claim 7 wherein the means for effecting relative displacement between the mandrel and the abrasive treatment station is arranged to operate at a relatively slow speed immediately prior to and during initial contact between a section and the abrading means and is arranged to operate at a relatively fast speed at other times.

12. Apparatus according to claim 1 wherein the support is a turret including means for rotating the turret with a relatively slow speed immediately prior to and during initial contact between a section and the abrading means and with a relatively fast speed at other times.

13. Apparatus according to claim 1 wherein each mandrel has a friction-faced collar against which the section is urged by the abrading means whereby, in use, relative rotation between the mandrel and the section thereon is minimized.

14. Apparatus according to claim 1 including means for adjusting the minimum spacing between the mandrel and the abrading means whereby sections of different outside diameters can be treated.

* * * * *